US006287384B2

(12) United States Patent
Oki et al.

(10) Patent No.: US 6,287,384 B2
(45) Date of Patent: Sep. 11, 2001

(54) CURTAIN COATING METHOD AND APPARATUS FOR PHOTOGRAPHIC PRINTING PAPER

(75) Inventors: Kazuhiro Oki; Yoshinobu Katagiri, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/358,396

(22) Filed: Jul. 22, 1999

Related U.S. Application Data

(62) Division of application No. 09/234,117, filed on Jan. 19, 1999.

(30) Foreign Application Priority Data

Jan. 19, 1998 (JP) ..... 10-7909
Jan. 20, 1998 (JP) ..... 10-8798

(51) Int. Cl.[7] ..... B05C 5/00; B05D 1/30
(52) U.S. Cl. ..... 118/412; 118/DIG. 4; 427/420
(58) Field of Search ..... 118/412, DIG. 4; 427/420

(56) References Cited

U.S. PATENT DOCUMENTS 4,479,987 * 10/1984 Koepke et al. ..... 427/402
4,830,887 * 5/1989 Reiter ..... 427/420

FOREIGN PATENT DOCUMENTS 160 609 * 11/1983 (DD) .
0 567 071 * 10/1993 (EP) .
0 566 503 A1 10/1993 (EP) .
0 567 071 A1 10/1993 (EP) .
0 636 423 A1 2/1995 (EP) .
0 636 423 * 2/1995 (EP) .

* cited by examiner

*Primary Examiner*—Shrive P. Beck
*Assistant Examiner*—Michael Cleveland
(74) *Attorney, Agent, or Firm*—Sughrue, Mion, Zinn, Macpeak & Seas, PLLC

(57) ABSTRACT

A curtain coating apparatus includes a hopper with a slide plane on which the coating solution flows and a hopper lip from where the coating solution begins to freely fall down as a free falling curtain. The apparatus also includes at least a pair of outlets disposed in a position along the edge part of the free falling curtain and situated at a fixed distance down from the hopper lip. Auxiliary solutions are introduced from the width directions so as to maintain the curtain in the width direction.

10 Claims, 3 Drawing Sheets

CURTAIN COATING METHOD AND APPARATUS FOR PHOTOGRAPHIC PRINTING PAPER

This is a divisional of the application Ser. No. 09/234,117 filed Jan. 19, 1999, the disclosure of which is incorporated herein by reference.

BACKGROUND OF THE INVENTION

1. Field of the Invention

This invention relates to a curtain coating method and a curtain coating apparatus for uniform application of coating solutions and, more particularly, to the method and the apparatus for curtain coating solutions on to a continuously travelling strip like support (hereinafter referred to as "web") which is employed in the production of photographic films, photographic printing papers, magnetic recording tapes, pressure-sensitive recording papers, offset plate materials and the like.

2. Description of the Related arts

Conventionally, a curtain coating technique has been applied to the production of photographic films, photographic printing papers and the like.

First, descriptions will be given of conventional curtain coating methods as follows.

The basic arts of curtain coating are described, e.g., in U.S. Pat. No. 3,508,947 and U.S. Pat. No. 3,632,374 which correspond to JP-B-49-24133 and JP-B-49-35447 respectively (The term "JP-B" as used herein means an "examined Japanese patent Publication").

Further, S. F. Kistler discloses a theory of curtain coating in "AlChe Winter National meeting" (1982), and describes the following three phenomena which predominantly determine the coating rate in the curtain coating method:

(1) the phenomenon that fine bubbles are entrained in a gap between a web and a coating solution (This phenomenon is called "the air entrainment phenomenon" hereinafter), (2) the phenomenon that a foot-like cross-sectional shape of the impingement zone can develop a pronounced heel that can give rise to coating nonuniformity. (This phenomenon is called "the heel phenomenon" hereinafter, and it occurs in a case where a coating solution is made to flow down at a high flow rate), and (3) the phenomenon that a coating solution bounds at the web surface without adhering thereto (This phenomenon is called "the sagging phenomenon" hereinafter, and it occurs in the same case as the phenomenon (2), namely a case where a coating solution is made to flow down at a high flow rate).

As for attempts to elevate the upper limit of coating speed in this curtain coating method, there is disclosed the means of inhibiting "the air entrainment phenomenon", e.g., by applying an electrostatic field between a web and a coating solution (JP-A-62-197176). (The term "JP-A" as used herein means an "unexamined published Japanese patent application").

In recent years, however, the coating operation has been performed at a high speed of 250 m/min or above and the flowing-down rate of a curtain of coating solution has also been increased. As a result thereof, the retardation of coating speed due to "the sagging phenomenon" has come to a greater problem than the retardation caused by the aforementioned "air entrainment phenomenon".

Generally speaking, in order to get rid of nonuniformity in the thickness of the edge part of a free falling curtain, a curtain coating apparatus is usually equipped with guide plates for truing up both the edges of the coating solution on the slide plane, or edge guides for supporting both edge parts of the free falling curtain. In many cases, however, the sagging phenomenon occurs in the edge part of the free falling curtain, in which a thickness of the curtain is apt to be nonuniform.

Methods for suppressing the sagging phenomenon and techniques to improve the conventional coating techniques are disclosed in the next two references.

U.S. Pat. No. 5,393,571 which corresponds to JP-A-3-146172 discloses a method of conducting a curtain coating in which a total viscosity of coating solutions is specified and a surface roughness of web is adjusted to at least 0.3 $\mu$m in order to achieve a high-speed coating in a high flow rate range beyond 4 cc/cm/sec.

U.S. Pat. No. 5,391,401 which corresponds to PCT publication translated in Japanese No. Hei6-503752 discloses a method of conducting a curtain coating stably in which a viscosity of coating solution to form the lowest layer is specified with using a pseudoplasticity solution as the coating solutions.

In these methods, the viscosity is specified in order to conduct a high-speed coating stably. However, specifying only the total viscosity or the lowest layer viscosity is insufficient for realizing the high-speed coating and the uniform coated surface condition in multilayer coating. For instance, the coating solution for the lowest layer is likely to be designed so as to have low viscosity and low gelatin concentration from the viewpoint of high-speed coating suitability, but the coating solution for an upper layer is generally made as dense as possible from the viewpoints of ease of preparation, feeding, reduction of drying load and so on, thereby resulting in a rise of gelatin concentration.

When the curtain coating method is adopted in the multilayer coating, it turned out that unevenness was caused in the coated film when there are large differences in gelatin concentration and viscosity between the coating solutions for the lowest layer and the directly upper layer. This is because, although the curtain is drawn out to be rendered thin at the times when it is formed from the slide plane and impinges on the web during the curtain coating operation, this drawn-out condition is not uniform in the direction of coating width in the case where there are large differences in gelatin concentration and viscosity between coating solutions for the lowest layer and the directly upper layer, resulting in generation of unevenness.

Next, a description will be given of conventional curtain coating apparatuses as follows.

In the steps of forming a free falling curtain, edge guides support both edge parts of the curtain formed, and various techniques thereto are disclosed. For example, Japanese examined patent publication No. Sho 58-37866 discloses a method of introducing an auxiliary liquid between the free falling curtain and the edge guides which are prepared at both the edge parts of the curtain, and Japanese examined patent publication No. Hei 6-61517 (hereinafter referred to as JP-B-6-61517) discloses a method of introducing an auxiliary liquid close to the hopper lip.

FIG. 1 is a perspective view of a basic structure of a curtain coating apparatus as an embodiment of the present invention.

A coating head 1 has a plurality of slits 12 respectively connected to manifolds 10, and the coating solutions extruded from each slit 12 flows down on a slide plane of a slide hopper 7 and falls down to form a free-falling curtain 5 of the coating solution.

Both sides of the curtain 5 are supported by edge guides 4, and the curtain 5 falls and impinges at a line on a surface of a web 3 which travels in the arrow direction while supported by a backup roller 2, so that a coated film 8 is formed.

FIG. 4 is a front view of a curtain coating apparatus to which an method disclosed in JP-B-58-37866 cited above is applied for introducing the auxiliary solution for the liquid curtain. Such an apparatus is shown as one example of conventional curtain coating apparatuses. In FIG. 4, each edge guide 4 is equipped with conduit 14 in a place situated downward at a fixed distance from the departing position of the liquid curtain from the hopper lip, and the conduit 14 is bent down so that its outlet turns to the lower side and each direction of the outlet are parallel to the falling direction of the free falling curtain 5.

FIG. 5 is a side view of a curtain coating apparatus to which a method disclosed in JP-B-6-61517 cited above is applied for introducing the auxiliary solution into the free falling curtain. Such an apparatus is shown as another example of the conventional curtain coating apparatuses. Therein, an auxiliary solution supply pipe 15 is kept upright and arranged upward at a fixed distance apart from the departing position of the liquid curtain from the hopper lip.

As shown in the above examples, the auxiliary liquid flows along each of the edge guides, so that the film formation can be stabilized and the coated film edge corresponding to the edge part of the liquid curtain is prevented from thickening.

With respect to the conventional technique as shown in FIG. 4, the conduit 14 is disposed so as to go across the edge guide 4 and project into the edge part of the free falling curtain 5. Thus, the outlet of the conduit must be bent to the lower side. As a result, it is required for the conduit to have an adequate length for changing the direction of the outlet by bending. This requirement occupies the minimum distance between the hopper lip and the outlet. Accordingly, there will be no introduction of the auxiliary solution into the section formed between the hopper lip and the outlet. If the edge thickening occurs in this section, the coating is carried out under the condition of the thick edge. Moreover, it is necessary for a bent part of the conduit to be projected into the free falling curtain 5 to cause a turbulent flow therein. As a result, there comes a problem of defection of longitudinal streaks in the coated layer.

With respect to the conventional technique as shown in FIG. 5, in taking into consideration a position where the auxiliary solution supply pipe 15 is disposed, the auxiliary solution is supplied from above to the edge of the liquid curtain in the thickness direction of the free falling curtain. In short, the auxiliary solution is supplied from outside of the free falling curtain 5. Therefore, it is difficult for the auxiliary solution to be supplied so as to go across the curtain edge in the thickness direction and uniformly reach the backside of the curtain 5. Specifically, in multilayer formation, such an uneven supply of the auxiliary solution makes a difference in edge part thickness between the upper layer and the lower layer. Moreover, it is very difficult to dispose the pipe 15 so that the auxiliary solution is supplied to the same position every time the coated layer is produced. Furthermore, since the auxiliary solution is brought into contact with a curtain surface, goes across the curtain and then reaches the edge part, the auxiliary solution is supplied from the direction in which the curtain flow maintaining pressure is weak. As a result, change in an auxiliary solution supplying pressure causes an external disturbance in the flow at the curtain surface, thereby causing such defects as longitudinal streaks.

SUMMARY OF THE INVENTION

In view of the foregoing, an object of the present invention is to provide a curtain coating method of coating solutions at high-speed without unevenness to form uniform coatings in multi-layer coating.

Another object of the present invention is to provide a curtain coating apparatus which can stabilize a formation of a free falling curtain, inhibit the free falling curtain from causing a defection of longitudinal streaks, and prevent a coated film edges corresponding to edge parts of a free falling curtain from thickening.

According to a first aspect of the present invention, there is provided a curtain coating method of coating a continuously travelling web with at least two kind of coating solutions superposed upon one another in layers, which includes supplying the coating solutions to flow and impinging on the web, in which differences in gelatin concentration and viscosity between the coating solutions for a lowest layer and a coating solution for an adjacent layer are adjusted to 0–2 weight percent and 0–20 cp respectively. The abbreviation "cp" represents centipoise.

In a curtain coating method according to the present invention, it is preferable that the gelatin concentration difference is adjusted to 0–1 weight percent and the gelatin viscosity difference is adjusted to 0–10 cp, and it is more preferably that both of the differences are adjusted to almost zero cp.

When satisfying the above conditions, it is preferable that concentration of the lowest layer is adjusted to 4–7 weight percent and viscosity thereof is adjusted to 40–80 cp.

In consideration of coating the web at high-speed, it is preferable that both the concentration and the viscosity of the coating solution to be coated as the lowest layer would be lower. However, the concentration and the viscosity of the coating solution to be coated as upper layers are generally settled to be high in view of mixing or feeding the solution and drying load for the coated layers. Therefore, the differences in gelatin concentration and viscosity between the coating solutions for the lowest layer and the coating solution for the upper layers tends to be large as the coating speed increases.

In the case where the differences in the gelatin concentration and viscosity between the coating solution for the lowest layer and the coating solution for the adjacent layer are too large, unevenness is caused in the coated film. However, the above mentioned first aspect of the present invention prevents unevenness.

According to a second aspect of the present invention, there is provided a curtain coating apparatus for coating the web with a coating solution including a hopper with a slide plane on which the coating solution flows and the coating solution is freely fallen down from a hopper lip as a free falling curtain, and at least a pair of conduits each disposed in a position along the edge part of the free falling curtain and situated at a fixed distance down from the hopper lip, in which the auxiliary solution is introduced so as to support the free falling curtain in the width direction of the free falling curtain.

In the above curtain coating apparatus, it is preferable that the fixed distance is adjusted to 0.1–1.5 mm.

Also, a centerline of outlets for discharging the auxiliary solution may be sloped to the direction in which the coating solution flows down. It is preferable for each outlets to slope downward within 30 degrees from the horizontal line.

It is preferable for each outlet to have a circular diametrical section of 0.4–1.5 mm in diameter. It is preferable that the amount of auxiliary solution discharged from each outlet is 3–8 cc/min.

Further, according to a third aspect of the present invention, there is provided a curtain coating apparatus for coating the web with a coating solution including a hopper with a slide plane on which the coating solution flows and the coating solution is freely fallen down from a hopper lip as a free falling curtain, and a pair of edge guides guiding both edge parts of the free falling curtain to the falling direction, at least a pair of conduits which are each disposed in a position along the edge part of the free falling curtain and situated at a fixed distance down from the hopper lip, in which the auxiliary solution is introduced so as to support the free falling curtain in the width direction thereof.

Due to the foregoing, the distance between the outlet of the conduit and the slide hopper lip can be made very short, and an edge thickening can be removed. Further, there is no factor disturbing a stream of the free falling curtain since only the leading end of each outlet is in direct contact with the edge of the free falling curtain, the remaining part of the conduit is not in contact with the free falling curtain at all, and the conduit is not projected into the curtain. Furthermore, the auxiliary solution is discharged so as to support the edge part of the free falling curtain, and so that the auxiliary solution comes almost simultaneously into contact with each face of the edge parts allowing the auxiliary solution be diffused uniformly. A pressure of the auxiliary solution supply is applied in the width direction of the free falling curtain. Since the free falling curtain is hardly effected in the width direction, the present apparatus enables the free falling curtain to be inhibited from causing a longitudinal streaks even when there are external disturbances including the discharge of the auxiliary solutions and fluctuation therein.

DETAILED DESCRIPTION OF THE PRESENT INVENTION

Figure 1:
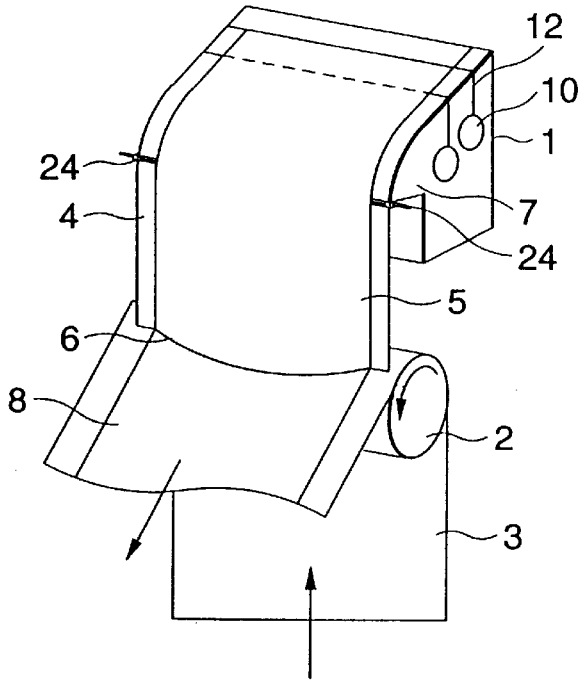
FIG. 1 is a perspective view of a curtain coating apparatus as an embodiment of the present invention.

Embodiments will be given of the present invention as follows.

[Layer Structure]

Composition of each constituent layer is described below. These layers will be used in the following embodiments according to curtain coating methods and apparatuses. Each figure on the right side designates the coverage (the amount of coating liquid) (g/m$^2$) of an ingredient corresponding thereto. As for the silver halide emulsion, the figure represents the coverage based on silver.

First Layer (Blue-Sensitive Emulsion Layer):

| | |
|---|---|
| Silver chlorobromide emulsion (crystal form: cube, average grain size: 0.79 $\mu$m, bromide content: 0.3 mole %) | 0.27 |
| Gelatin | 1.22 |

-continued

| | |
|---|---|
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Color image stabilizer (Cpd-5) | 0.01 |
| Solvent (Solv-1) | 0.13 |
| Solvent (Solv-5) | 0.13 |

Second Layer (Color Stain Inhibiting Layer):

| | |
|---|---|
| Gelatin | 0.90 |
| Color stain inhibitor (Cpd-4) | 0.08 |
| Solvent (Solv-1) | 0.10 |
| Solvent (Solv-2) | 0.15 |
| Solvent (Solv-3) | 0.12 |
| Color image stabilizer (Cpd-7) | 0.12 |
| Solvent (Solv-8) | 0.03 |

Third Layer (Green-Sensitive Emulsion Layer):

| | |
|---|---|
| Silver chlorobromide emulsion (crystal form: cube, average grain size: 0.79 $\mu$m, bromide content: 0.3 mole %) | 0.13 |
| Gelatin | 1.45 |
| Magenta coupler (ExM) | 0.16 |
| Ultraviolet absorbent (UV-2) | 0.16 |
| Color image stabilizer (Cpd-2) | 0.03 |
| Color image stabilizer (Cpd-4) | 0.03 |
| Color image stabilizer (Cpd-5) | 0.10 |
| Color image stabilizer (Cpd-6) | 0.01 |
| Color image stabilizer (Cpd-7) | 0.08 |
| Color image stabilizer (Cpd-8) | 0.01 |
| Color image stabilizer (Cpd-10) | 0.02 |
| Color image stabilizer (Cpd-16) | 0.02 |
| Solvent (Solv-3) | 0.13 |
| Solvent (Solv-4) | 0.39 |
| Solvent (Solv-6) | 0.26 |

Fourth Layer (Color Stain Inhibiting Layer):

| | |
|---|---|
| Gelatin | 0.68 |
| Color stain inhibitor (Cpd-4) | 0.06 |
| Solvent (Solv-1) | 0.07 |
| Solvent (Solv-2) | 0.11 |
| Solvent (Solv-3) | 0.09 |
| Color image stabilizer (Cpd-7) | 0.09 |
| Solvent (Solv-8) | 0.02 |

Fifth layer (Red-Sensitive Emulsion Layer):

| | |
|---|---|
| Silver chlorobromide emulsion (crystal form: cube, average grain size: 0.43 $\mu$m, bromide content: 0.8 mole %) | 0.18 |
| Gelatin | 0.80 |
| Cyan coupler (ExC) | 0.33 |
| Ultraviolet absorbent (UV-2) | 0.18 |
| Color image stabilizer (Cpd-1) | 0.33 |
| Color image stabilizer (Cpd-2) | 0.03 |
| Color image stabilizer (Cpd-6) | 0.01 |
| Color image stabilizer (Cpd-8) | 0.01 |
| Color image stabilizer (Cpd-9) | 0.02 |
| Colo; image stabilizer (Cpd-10) | 0.10 |
| Color image stabilizer (Cpd-15) | 0.04 |

-continued

| | |
|---|---|
| Solvent (Solv-1) | 0.01 |
| Solvent (Solv-7) | 0.22 |

Sixth layer (Ultraviolet Absorbing Layer):

| | |
|---|---|
| Gelatin | 0.48 |
| Ultraviolet absorbent (UV-1) | 0.38 |
| Color image stabilizer (Cpd-5) | 0.01 |
| Color image stabilizer (Cpd-7) | 0.05 |
| Solvent (Solv-10) | 0.03 |
| Solvent (Solv-9) | 0.03 |
| Stabilizer (Cpd-14) | 0.03 |

Seventh Layer (Protective Layer):

| | |
|---|---|
| Gelatin | 0.90 |
| Acryl-modified polyvinyl alcohol (modification degree: 17%) | 0.05 |
| Liquid paraffin | 0.02 |
| Color image stabilizer (Cpd-11) | 0.01 |

The structural formulae of the compounds used herein are illustrated below:

(ExY) Yellow Coupler

1:1 (by mole) mixture of

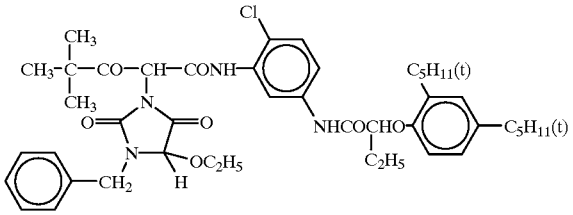

with

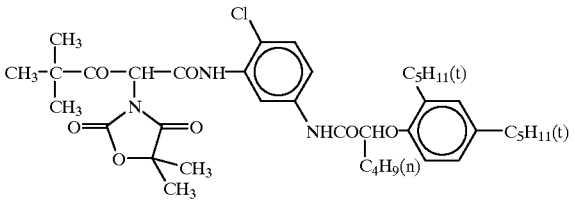

(ExM) Magenta Coupler

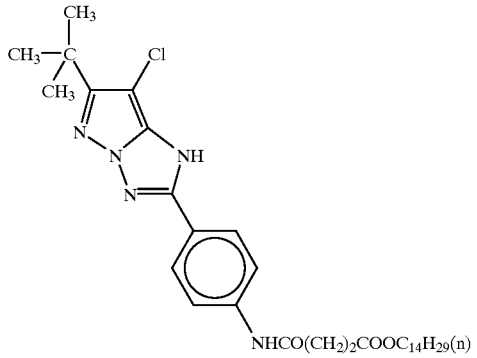

(ExC) Cyan Coupler

25:75 (by mole) mixture of

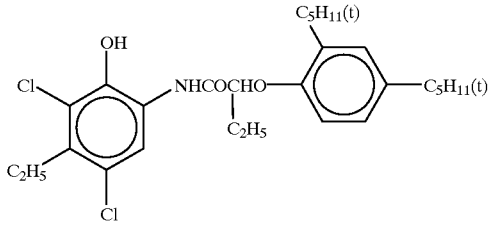

with

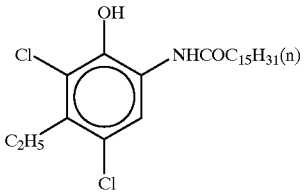

(Cpd-1) Color Image Stabilizer

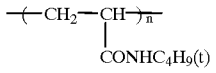

(Cpd-2) Color Image Stabilizer

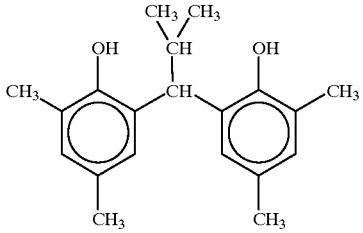

(Cpd-3) Color Image Stabilizer
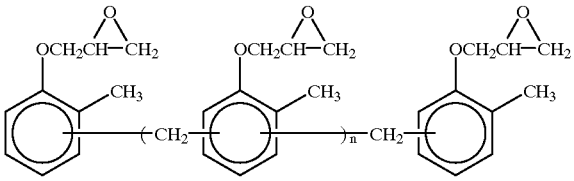
n = 7–8 (on average)
(Cpd-4) Color Stain Inhibitor
1:1:1 (by weight) mixture of
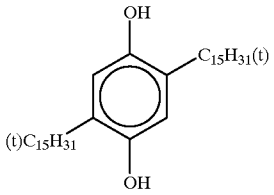
,
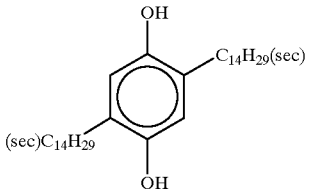
,
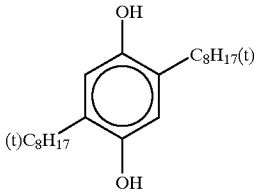
(Cpd-5) Color Image Stabilizer
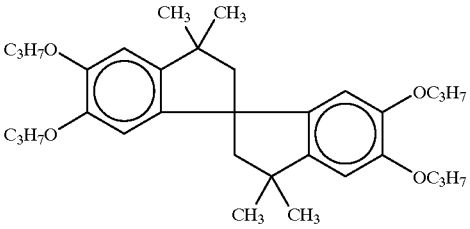
,
(Cpd-6) Color Image Stabilizer
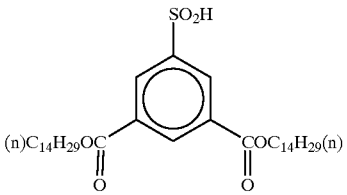
(Cpd-7) Color Image Stabilizer
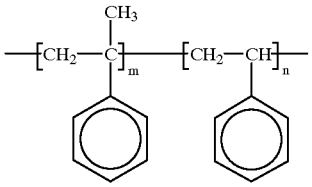
(Cpd-8) Color Image Stabilizer
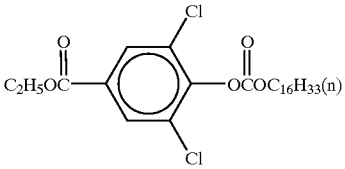
(Cpd-9) Color Image Stabilizer
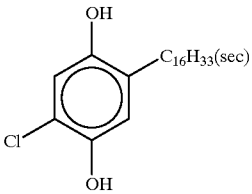
(Cpd-10) Color Image Stabilizer
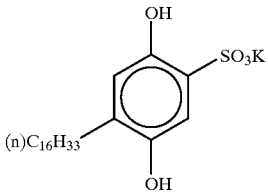
(Cpd-11) Color Image Stabilizer
1:2:1 (by weight) mixture of i), ii) and iii)
i)
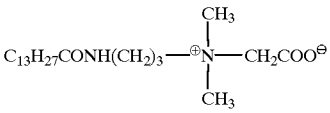
ii)
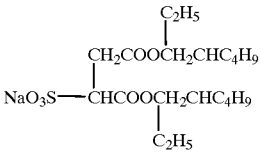
iii)
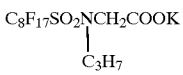

(Cpd-14) Stabilizer
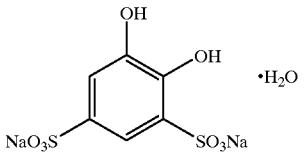
(Cpd-15) Color Image Stabilizer
Methacrylic acid/n-butylacrylate copolymer (40/60 by weight)
(Cpd-16) Color Image Stabilizer
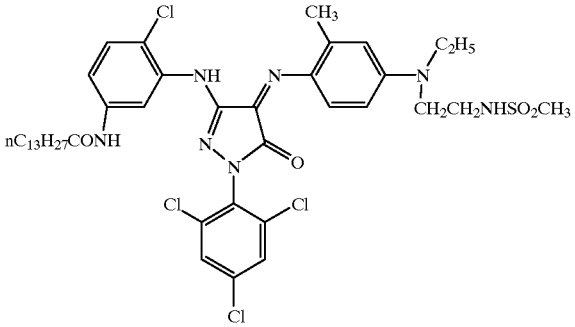
(UV-1) Ultraviolet Absorbent
1:2:2:3:1 (by weight) mixture of (iv), (v), (vi), (vii) and (viii)
(iv)
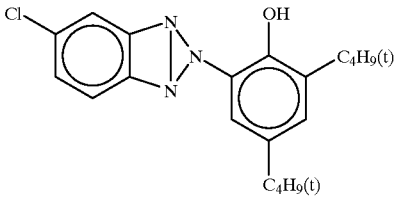
(v)
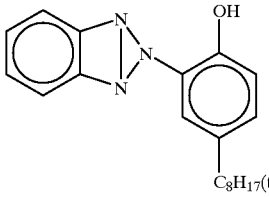
(vi)
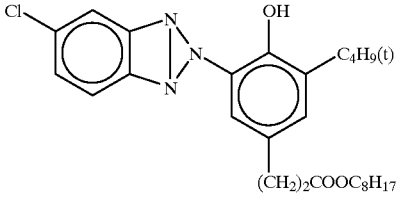
-continued
(vii)
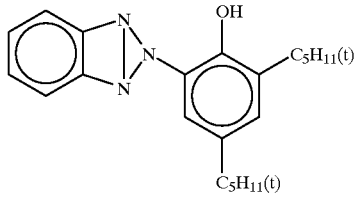
(viii)
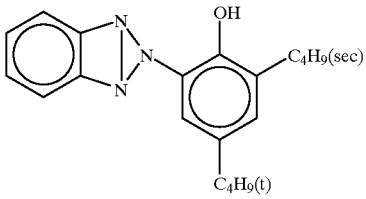
(UV-2) Ultraviolet Absorbent
2:3:4:1 (by weight) mixture of (ix), (x), (xi) and (xii)
(ix)
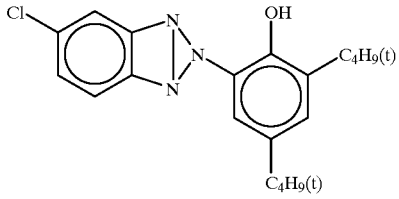
(x)
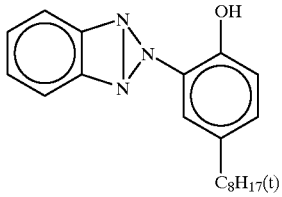
(xi)
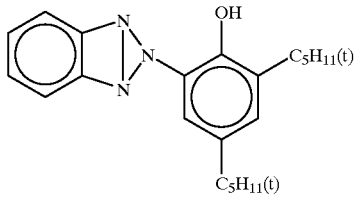
(xii)
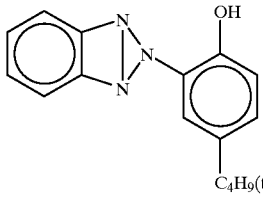
(Solv-1) Solvent
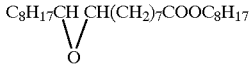
(Solv-2) Solvent
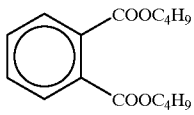

-continued (Solv-3) Solvent

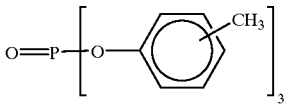

(Solv-4) Solvent

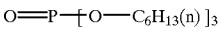

(Solv-5) Solvent

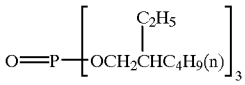

(Solv-6) Solvent

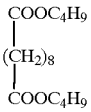

(Solv-7) Solvent

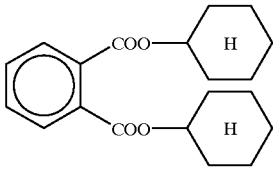

(Solv-8) Solvent

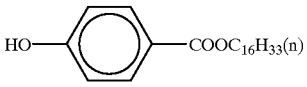

(Solv-9) Solvent

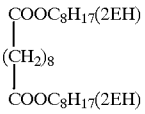

(Solv-10) Solvent

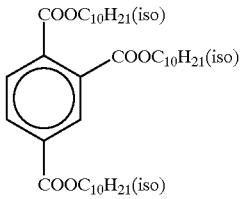

[Curtain Coating Methods]

Embodiments of the present curtain coating method are described below in detail.

As shown in FIG. 1, a coating head 1 has a plurality of slits connected to manifolds 10 respectively, a coating solution extruded from the slits flows down on a slide plane of a slide hopper 7 and fall down to form a free falling curtain 5 of coating solutions.

Edge guides 4 support both sides of the free falling curtain 5. The free falling curtain 5 falls down and impinges on a web 3 which is supported by a backup roller 2, thereby forming a coated film 8.

The distance between a line 6 where the free falling curtain 5 impinges and a lip part of the slide hopper 7 can be adjusted properly, e.g. to the order of 100 mm.

The present invention can be embodied with such an apparatus as mentioned above.

To sum up, the coating solution falls and impinges on a surface of the web 3, which continuously travels as shown in FIG. 1, as the free falling curtain, and the coating solutions are applied to the web 3.

EXAMPLES AND COMPARATIVE EXAMPLES OF THE COATING METHOD

With using the aforementioned curtain coating method, multilayer color photographic papers are produced by coating various photographic constituent layers on a polyethylene-laminated baryta paper having a subbing layer. The apparatus as shown in FIG. 1 is used in the following examples and comparative examples.

On the basis of the aforementioned layer structure, the gelatin concentration and viscosity of the coating solution for the first layer (blue-sensitive emulsion layer) and those of the coating solution for the second layer (color stain inhibiting layer) are modified so as to adjust conditions imposed in each example by addition of water and sodium polystyrene sulfonate as a thickener. Curtain coating performance in each example is graded with "excellent", "good" or "bad" by photographic processing result of each photographic paper.

Here, the word "excellent" means that there is no color unevenness and no streaks appeared, the word "good" means that there are a little color unevenness or longitudinal streaks and "bad" means that there are strong color unevenness or longitudinal streaks.

In each example, the distance between the line 6 where the free falling curtain 5 impinges and the lip part of the slide hopper 7 is adjusted to 100 mm, and an angle between the horizontal line and the web 3 is adjusted at 60 degrees.

TABLE A1

| | Layer | Viscosity | Concn. | Evaluation |
|---|---|---|---|---|
| Comparative | The first layer (blue-sensitive emulsion layer) | 30 cp | 3 wt % | Bad |
| Example A1 | The second layer (color stain inhibiting layer) | 70 cp | 8 wt % | |
| Comparative | The first layer (blue-sensitive emulsion layer) | 50 cp | 3 wt % | Good |
| Example A2 | The second layer (color stain inhibiting layer) | 70 cp | 8 wt % | |
| Comparative | The first layer (blue-sensitive emulsion layer) | 30 cp | 6 wt % | Good |
| Example A3 | The second layer (color stain inhibiting layer) | 70 cp | 8 wt % | |

TABLE A2

| | Layer | Viscosity | Concn. | Evaluation |
|---|---|---|---|---|
| Example A1 | The first layer (blue-sensitive emulsion layer) | 50 cp | 6 wt % | Excellent |
| | The second layer (color stain inhibiting layer) | 70 cp | 8 wt % | |
| Example A2 | The first layer (blue-sensitive emulsion layer) | 30 cp | 3 wt % | Excellent |
| | The second layer (color stain inhibiting layer) | 50 cp | 5 wt % | |

In comparative examples A1, A2 and A3, when only the gelatin concentration difference or the viscosity difference is adjusted, some improvements can be measured, but it is still insufficient for the curtain coating to be prevented from coating the curtain with evenness in thickness or the like.

In examples A1 and A2 in accordance with the present invention, when both the gelatin concentration difference and the viscosity difference are adjusted, sufficient improvements can be measured. In this case, either of the layers may be adjusted.

In examples A3 and A4 and comparative examples A4 and A5, the layer structure is described in which another gelatin layer whose concentration and viscosity are different from the foregoing layers is added directly on or under the lowest layer as an additional layer.

In each case, a surfactant is added to the lowest layer to stabilize the film formation.

In example A5 and comparative example A6, a dilute layer in concentration compared with the lowest layer is added under the lowest layer as examples in the case where dilution is required from the viewpoint of high-speed coating suitability of the reduction in coverage of a surfactant per unit area of the coated film is required.

TABLE A3

| | Layer | Viscosity | Concn. | Evaluation |
|---|---|---|---|---|
| Comparative | The first layer (aqueous gelatin solution) | 30 cp | 3 wt % | Bad |
| Example A4 | The second layer (blue-sensitive emulsion) | 70 cp | 8 wt % | |
| Comparative | The first layer (blue-sensitive emulsion) | 30 cp | 3 wt % | Bad |
| Example A5 | The second layer (aqueous gelatin solution) | 70 cp | 8 wt % | |
| Comparative | The first layer (diluted blue-sensitive emulsion) | 30 cp | 3 wt % | Bad |
| Example A6 | The second layer (blue-sensitive emulsion) | 70 cp | 8 wt % | |

TABLE A4

| | Layer | Viscosity | Concn. | Evaluation |
|---|---|---|---|---|
| Example A3 | The first layer (aqueous gelatin solution) | 50 cp | 6 wt % | Excellent |
| | The second layer (blue-sensitive emulsion) | 70 cp | 8 wt % | |
| Example A4 | The first layer (blue-sensitive emulsion) | 50 cp | 6 wt % | Excellent |
| | The second layer (aqueous gelatin solution) | 70 cp | 8 wt % | |
| Example A5 | The first layer (diluted blue-sensitive emulsion) | 50 cp | 6 wt % | Excellent |
| | The second layer (blue-sensitive emulsion) | 70 cp | 8 wt % | |

In accordance with the present coating method, as mentioned above, the lowest layer and its directly upper layer stand in specific relations with respect to gelatin concentration and viscosity, by which the uniform and steady coating can be realized in high-speed and multilayer coating.

[Curtain Coating Apparatus]

Embodiments of the present curtain coating apparatus are described below in detail.

As the basic constituent members of the present curtain coating apparatus shown in FIG. 1, edge guides and auxiliary solution supply conduits are attached.

Additionally, the distance between a line 6 where the free falling curtain impinges and a lip part (end part) of the slide hopper 7 can be adjusted to, e.g. the order of 100 mm.

Figure 2:
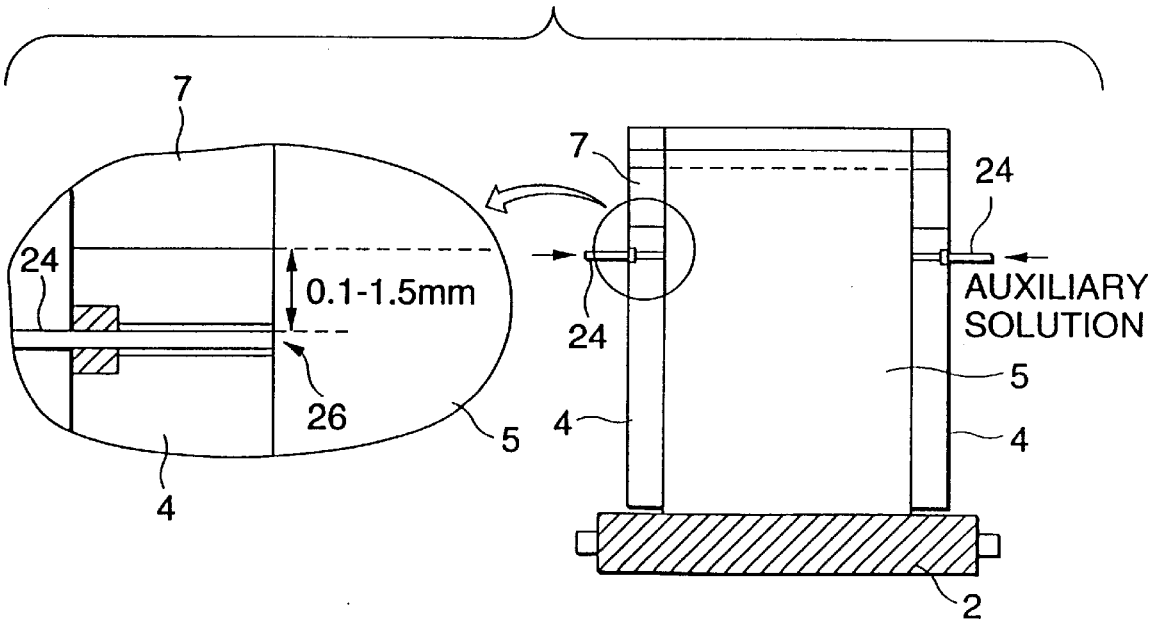
FIG. 2 is a front view of the curtain coating apparatus shown in FIG. 1.

FIG. 2 is a front view of the curtain coating apparatus shown in FIG. 1.

Therein each outlet 26 of an auxiliary solution supply conduit 24 is fitted in each edge guide 4 guiding either edge situated along the curtain edge and 0.1–1.5 mm apart from the starting-point where the free falling curtain begins to fall at the end of the slide hopper 7. Each outlet for discharging an auxiliary solution opens to the width direction of the free falling curtain so as to supply the auxiliary solution so that each auxiliary solution maintains the free falling curtain, and does not project into the free falling curtain.

Additionally, the distance between the outlet and the starting-point where the free falling curtain begins to fall is determined in taking account whether the free falling curtain can be held stably by the edge guides, the auxiliary solution can be supplied exactly to the edge part of the free falling curtain from the place very close to the hopper lip, and so on.

The coating solution fed from a manifold 10 via a slit 12 which are respectively installed in a coating head 1 flows down on the slide plane of the slide hopper 7. Then, the coating solution reaches the hopper lip and falls down freely. While falling, the coating solution width is controlled by each edge guide 4 disposed on the both sides of the coating solution and the auxiliary solution is discharged from each outlet fitted in each of the edge guide. Although the auxiliary solution is discharged in a slight amount of from 3 to 8 cc/min, the presence of the auxiliary solution between the edge guide 4 and the free falling curtain 5 can have sufficient effect in preventing the emergence of thickness distribution of the free falling curtain between the edge part and the central part thereof. In addition, the outlets themselves have no interference in the free falling curtain, and the auxiliary solution discharged therefrom has no other appreciable influence on the free falling curtain 5 because the amount thereof is so small that the auxiliary solution flow pushing aside the free falling curtain is very thin.

Figure 3:
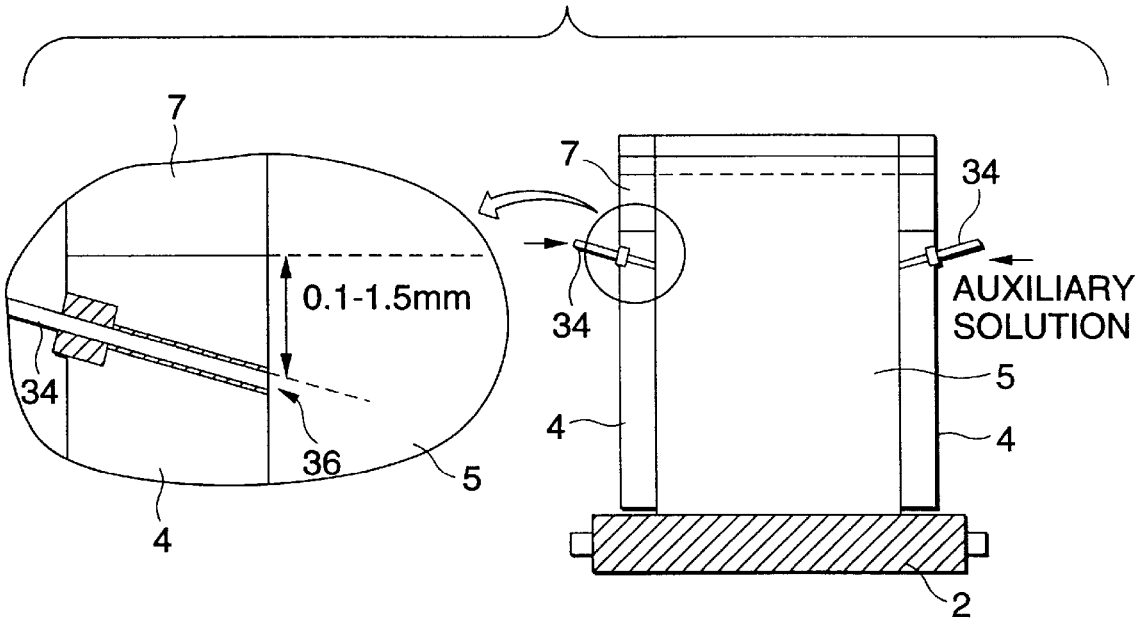
FIG. 3 is a front view of a curtain coating apparatus as another embodiment of the present invention.

FIG. 3 is a front view of a curtain coating apparatus as another embodiment of the present invention.

This apparatus resembles the embodiment shown in FIG. 2 in a structural feature that an outlet 36 of an auxiliary solution supply conduit 34 is fitted in each edge guide 4 guiding either edge part of the free falling curtain 5 at a place which is situated along the curtain edge and 0.1–1.5 mm apart from the hopper lip. However, the different point from the embodiment shown in FIG. 2 is the opening direction of the outlets. More specifically, each of the outlets is disposed so as to slope down to the falling direction of the free falling curtain from the width direction of the free falling curtain. On the other hand, it is similar to the embodiment shown in FIG. 2 that the auxiliary solution is introduced so as to maintain the edge part of the free falling curtain and there is no projection into the free falling curtain.

By such a disposition of outlets also, the coating apparatus can have function and effect equal to or better than those of the coating apparatus shown in FIG. 2.

Additionally, it is desirable that the angle of the foregoing slope is within 30 degrees.

Now, the advantages of the present coating apparatus will be illustrated more clearly by reference to the following examples. In these examples, the coating operations for preparing photographic paper or lithographic film can be carried out.

Samples of multilayer color photographic paper having the following layer structure were each prepared by coating various photographic constituent layers on a polyethylene-laminated baryta paper having a subbing layer. The coating operation for preparing each sample was performed using the curtain coating apparatus as shown in FIG. 1.

The same as the aforementioned layer structure is used in the following examples.

Based on the foregoing formula, the viscosity of coating solutions is adjusted properly by the addition of water and sodium polystyrenesulfonate as a thickener.

In performing the coating operations, the auxiliary solutions having the compositions set forth in Table B1 is used at various flow rates in accordance with the addition methods shown in Table B2. The thus prepared samples of the multilayer coating on the web were each examined for thickness change in edge part and longitudinal streaks. The examination results are shown in Table B2.

Additionally, in the curtain coating apparatus used, the distance between the lip part of the slide hopper and the web was maintained at 100 mm, and the angle formed by the web with the horizontal line at the coating position was set at 60 degrees.

TABLE B1

| | Auxiliary Solution 1 | Auxiliary Solution 2 | Auxiliary Solution 3 |
|---|---|---|---|
| Water | 100 | 65 | 62 |
| Methanol | — | 35 | 35 |
| Gelatin | — | — | 2 |

TABLE B2

Figure 4:
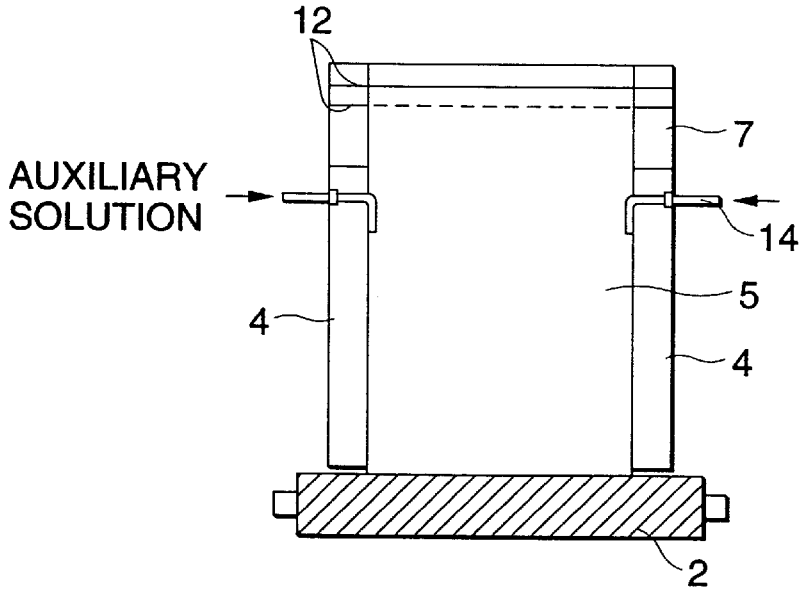
FIG.4 PRIOR ART
FIG. 4 is a front view of the curtain coating apparatus disclosed in a conventional art.
Figure 5:
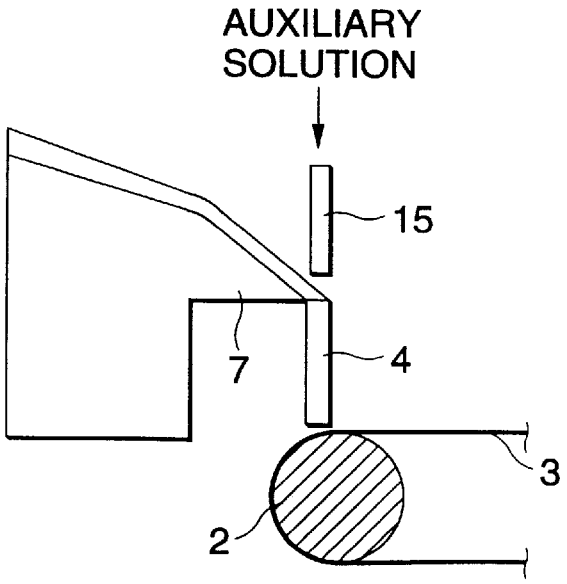
FIG.5 PRIOR ART
FIG. 5 is a side view of another conventional curtain coating apparatus.

| | Auxiliary solution adding method | Composition of auxiliary Solution | Flow rate (cc/min) | Thickening of coated film edge | Longitudinal streaks |
|---|---|---|---|---|---|
| Comparative Example B1 | FIG. 4 | Solution 1 | 5 | N | Caused |
| Comparative Example B2 | FIG. 5 | Solution 1 | 5 | N | Caused |
| Example B1 | FIG. 2 | Solution 1 | 5 | P | Not caused |
| Example B2 | FIG. 2 | Solution 1 | 8 | P | Not caused |
| Comparative Example B3 | FIG. 2 | Solution 1 | 2 | P | Caused |
| Comparative Example B4 | FIG. 2 | Solution 1 | 10 | N | Not caused |
| Example B3 | FIG. 2 | Solution 2 | 5 | P | Not caused |
| Example B4 | FIG. 2 | Solution 3 | 5 | P | Not caused |

P: within the permissible extent

N: beyond the permissible extent

Making a comparison between the coating operations in Comparative Examples B1–B2 and Example B1, it can be seen from the above that, although the same auxiliary solution was introduced at the same flow rate, only the photographic paper prepared in Example B1 achieved good results with respect to the thickening of the coated film edge and defects of longitudinal streaks. Further, as can be seen from the comparison between Comparative Examples B3–B4 and Examples B1–B2, the appropriate flow rate of an auxiliary solution was of the order of 3–8 cc/min. In addition, the results of Examples B1, B3 and B4 have proved that the intended effects were obtained, irrespective of the composition of an auxiliary solution used, as long as the present coating method was adopted.

Samples of lithographic film having the layer structure described below were each prepared as prescribed below. The coating operations therein were performed using the curtain coating apparatus as shown in FIG. 1.

The first subbing layer according to the formula (1) and the second subbing layer according to the formula (2) were coated successively on both surfaces of a 100 $\mu$m-thick biaxially stretched polyethylene terephthalate film.

Formula (1) for First Subbing Layer:

| | |
|---|---|
| Vinylidene chloride latex | 15 parts by weight |

(Aqueous dispersion of core/shell latex constituted of 90 weight percent core part and 10 weight percent shell part)

Core part; vinylidene chloride/methylacrylate/methylmethacrylate/acrylonitrile/acrylic acid (93/3/3/0.9/0.1)

Shell part; vinylidene chloride/methylacrylate/methylmethacrylate/acrylonitrile/acrylic acid (90/3/3/2/2)

| | |
|---|---|
| 2,4-Dichloro-6-hydroxy-s-triazine | 0.25 parts by weight |
| Fine particles of polystyrene (Average diameter: 3 μm) | 0.05 parts by weight |
| Distilled water to make | 100 parts by weight |

Thereto, a 10 weight percent KOH was further added to adjust the pH to 6±0.3.

In coating this coating solution, the solution temperature was kept at 10° C. The layer coated was dried at 180° C. for 2 minutes. The coating condition of this coating solution was set so that the layer coated had a dry thickness of 1 μm.

Formula (2) for Second Subbing Layer:

| | |
|---|---|
| Gelatin | 1 parts by weight |
| Methyl cellulose | 0.05 parts by weight |
| Compound (1) | 0.02 parts by weight |
| $C_{12}H_{25}O(CH_2CH_2O)_{10}H$ | 0.03 parts by weight |
| Compound (2) | $3.5 \times 10^{-3}$ parts by weight |
| Acetic acid | 0.2 parts by weight |
| Water to make | 100 parts by weight |

This coating solution was coated so as to have a dry thickness of 0.1 μm. Therein, the drying was carried out at 170° C. for 2 minutes.

Compound (1)

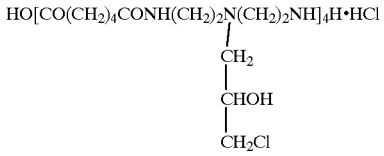

Compound (2)

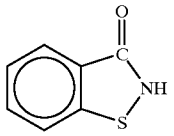

On one side of the thus obtained support, two layers, a conductive layer of the following formula (3) and a backing layer of the following formula (4), were coated simultaneously.

Solutions as shown in Table B1 are obtained by adding a backing layer shown below to each of LiCl, NaCl and KCl.

Formula (3) for Conductive Layer:

| | |
|---|---|
| $SnO_2$/Sb (9/1 by weight, average grain size: 0.25 μ) | 300 mg/m$^2$ |
| Gelatin | 170 parts by weight |
| Compound (2) | 7 parts by weight |
| Sodium dodecylbenzenesulfonate | 10 parts by weight |
| Sodium dihexyl-α-sulfosuccinate | 40 parts by weight |
| Sodium polystyrenesulfonate | 9 parts by weight |

Formula (4) for Backing Layer:

| | |
|---|---|
| Gelatin | 2.9 g/m$^2$ |
| Compound (2) | 10 parts by weight |
| Sodium dodecylbenzenesulfonate | 70 parts by weight |
| Sodium dibenzyl-α-sulfosuccinate | 15 mg/m$^2$ |
| 1,1'-Bis(vinylsulfonyl) methane | 150 parts by weight |
| Ethylacrylate latex (Average particle size: 0.05 μ) | 500 parts by weight |
| Lithium perfluorooctanesulfonate | 10 parts by weight |
| Finely pulverized silicon dioxide (Average particle size: 4 μ, pore diameter: 170 A, surface area: 300 m$^2$/g) | 35 parts by weight |

On the other side of the support, the silver halide emulsion layer of the following formula (5) and the protective layer of the following formula (6) were coated successively.

Formula (5) for Silver Halide Emulsion Layer

Solution I; Water: 300 ml, gelatin: 9 g.

Solution II; $AgNO_3$: 100 g, water: 400 ml

Solution III; NaCl: 37 g, $(NH_4)_3RhCl_6$: 1.1 ml, water: 400 ml

Solutions II and III were added simultaneously at a constant rate to Solution I kept at 45° C. to make an emulsion. After removal of soluble salts from the emulsion in the usual way well known to one skilled in the art, the resulting emulsion was admixed with gelatin, and thereto 6-methyl-4-hydroxy-1,3,3a,7-tetraazaindene as a stabilizer wad further added. The thus made emulsion was a monodisperse emulsion having an average grain size of 0.20 μm and the gelatin content therein was 60 g per kg of emulsion.

To the thus prepared emulsion, the following ingredients were further added:

| | |
|---|---|
| Compound (3) | $6 \times 10^{-3}$ mole/mole Ag |
| Compound (4) | 60 mg/m$^2$ |
| Compound (5) | 9 mg/m$^2$ |
| Compound (2) | 10 mg/m$^2$ |
| Sodium polystyrenesulfonate | 40 mg/m$^2$ |
| Sodium N-oleoyl-N-methyltaurine | 50 mg/m$^2$ |
| 1,1'-Bis (vinylsufonyl)methane | 70 mg/m$^2$ |
| 1-Phenyl-5-mercaptotetrazole | 3 mg/m$^2$ |
| Ethylacrylate latex (average particle size: 0.05 μm) | 0.46 g/m$^2$ |

The thus prepared emulsion was coated so as to have a silver coverage of 1.3 g/m$^2$.

Compound (3)

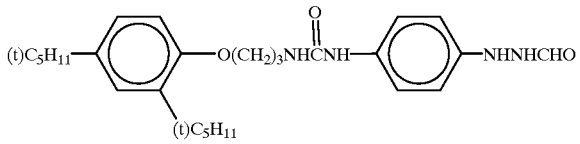

Compound (4)

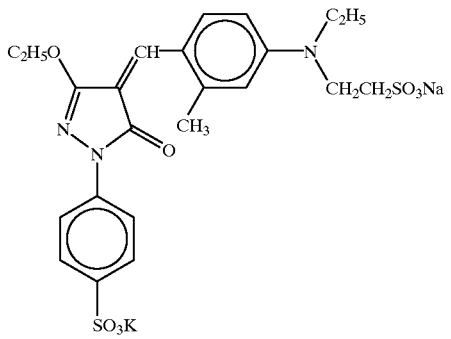

Compound (5)

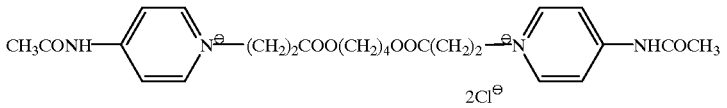

Formula (6) for Protective Layer:

| | |
|---|---|
| Gelatin | 1.0 g/m$^2$ |
| Lipoic acid | 5 mg/m$^2$ |
| Sodium dodecylbenzenesulfonate | 5 mg/m$^2$ |
| Compound (6) | 20 mg/m$^2$ |
| Sodium polystyrenesulfonate | 10 mg/m$^2$ |
| Compound (7) | 20 mg/m$^2$ |
| Ethylacrylate latex (average particle diameter: 0.05 $\mu$) | 209 mg/m$^2$ |

Compound (6)

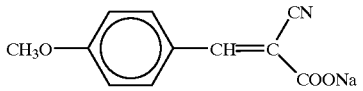

Compound (7)

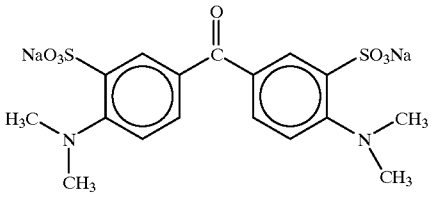

As can be seen from Table B3, neither longitudinal streaks nor edge thickening were caused in the production of lithographic films by means of the present curtain coating apparatus.

Additionally, although the aforementioned embodiments of the present invention and Examples according to the present invention were illustrated taking the production of photographic paper or lithographic film as an instance, it should be understood that the present invention can be applied to any coating apparatus in which a slide hopper is used.

In a coating apparatus according to the present invention, as mentioned above, the distance between each outlet and the hopper lip can be made very short to exclude the factor thickening the edges of the free falling curtain; as a result, the coated film edges are inhibited from thickening. Further, there is no factor disturbing the stream of the free falling curtain since only the leading end of each outlet is in direct contact with the edge of the free falling curtain, and so each pipe does not project into the curtain; as a result, no longitudinal streaks appears. Furthermore, the auxiliary solution is discharged so as to maintain the edge part of the free falling curtain, and thereby it comes almost simultaneously into contact with all faces of the edge part to effect the uniform dispersion into the edge part. Accordingly, no difference in thickness is made between the front and backsides of the curtain edge. In addition, the pressure of auxiliary solution supply is applied in the width direction of the free falling curtain. Since this direction is the most resistant to the influence of external disturbance, the present apparatus enables the curtain to be inhibited from causing longitudinal streaks in spite of the external disturbance due to discharge of an auxiliary solution. Thus, the present coating apparatus enables the stabilized formation of the free falling curtain, the prevention from longitudinal streaks, and the prevention of the thickening of the coated film edges corresponding to edge parts of the free falling curtain.

What is claimed is:

1. An apparatus for coating a web to be coated with a coating solution as a free falling curtain comprising:

a hopper with a slide plane on which said coating solution flows and with a hopper lip from where said coating solution begins to fall down as said free falling curtain;

a pair of edge guides guiding both edge parts of said curtain to the falling direction; and at least a pair of outlets for discharging an auxiliary solution directly into contact with an edge of said free falling curtain at the site of discharge which are dis-

TABLE B3

| | Auxiliary solution adding method | Composition of auxiliary Solution | Flow rate (cc/min) | Thickening of coated film edge | Longitudinal streaks |
|---|---|---|---|---|---|
| Example B5 | FIG. 2 | Solution 1 | 5 | P | Not caused |
| Example B6 | FIG. 2 | Solution 2 | 5 | P | Not caused |
| Example B7 | FIG. 2 | Solution 3 | 5 | P | Not caused |

posed in said edge guides along each edge part of said curtain and at a fixed distance downward from the hopper lip;

wherein each of said auxiliary solutions is introduced between said free falling curtain and said edge guides from the width directions so as to maintain said curtain in the width direction, and wherein at least a pipe penetrating said edge guides supplies the auxiliary solution to said curtain through said outlets.

2. An apparatus as claimed in claim 1, wherein said fixed distance is 0.1–1.5 mm.

3. An apparatus as claimed in claim 1, wherein each of said outlets has a circular diametrical section of 0.4–1.5 mm in diameter.

4. An apparatus as claimed in claim 1, wherein a discharging rate from each of said outlets is 3–8 cc/min.

5. An apparatus for coating a web to be coated with a coating solution as a free falling curtain comprising:

a hopper with a slide plane on which said coating solution flows and with a hopper lip from where said coating solution begins to fall down as said free failing curtain;

a pair of edge guides guiding both edge parts of said curtain to the falling direction;

at least a pair of outlets for discharging an auxiliary solution directly into contact in a horizontal direction with an edge of said free falling curtain at the site of discharge to maintain the width of the free falling curtain, wherein the pair of outlets are disposed in said edge guides along each edge part of said curtain and at a fixed distance downward from the hopper lip, and wherein at least a pipe penetrating said edge guides supplies the auxiliary solution to said curtain through said outlets.

6. An apparatus as claimed in claim 5, wherein said fixed distance is 0.1–1.5 mm.

7. An apparatus as claimed in claim 5, wherein a centerline of said outlet is sloped to the flowing direction.

8. An apparatus as claimed in claim 7, wherein an angle between the centerline of said outlets and a horizontal line is within 30 degrees.

9. An apparatus as claimed in claim 5, wherein each of said outlets has a circular diametrical section of 0.4–1.5 mm in diameter.

10. An apparatus as claimed in claim 5, wherein a discharging rate from each of said outlets is 3–8 cc/min.

* * * * *